US010629347B1

(12) United States Patent
Painter

(10) Patent No.: US 10,629,347 B1
(45) **Date of Patent: *Apr. 21, 2020**

(54) SUPERCONDUCTING MAGNET HAVING A VARIABLE ELECTRICALLY RESISTIVE LAYER AND METHOD OF USE

(71) Applicant: The Florida State University Research Foundation, Inc., Tallahassee, FL (US)

(72) Inventor: Thomas Painter, Tallahassee, FL (US)

(73) Assignee: THE FLORIDA STATE UNIVERSITY RESEARCH FOUNDATION, INC., Tallahassee, FL (US)

( * ) Notice: Subject to any disclaimer, the term of this patent is extended or adjusted under 35 U.S.C. 154(b) by 230 days.

This patent is subject to a terminal disclaimer.

(21) Appl. No.: 15/215,177

(22) Filed: Jul. 20, 2016

Related U.S. Application Data

(60) Provisional application No. 62/194,587, filed on Jul. 20, 2015.

(51) Int. Cl.
*H01F 6/06* (2006.01)
*H01F 1/03* (2006.01)

(52) U.S. Cl.
CPC ..... *H01F 6/06* (2013.01); *H01F 1/0313* (2013.01)

(58) Field of Classification Search
CPC ..... H01F 1/0313; H01F 6/06
See application file for complete search history.

(56) References Cited

U.S. PATENT DOCUMENTS 4,330,347 A * 5/1982 Hirayama ..... H01B 12/02 148/282
5,731,939 A * 3/1998 Gross ..... H02H 7/001 361/115
6,308,399 B1 * 10/2001 Zhou ..... C04B 35/45 29/599
2002/0028749 A1 * 3/2002 Fujikami ..... C23C 26/00 505/231
2002/0045552 A1 * 4/2002 Ayai ..... H01L 39/143 505/431
2003/0032560 A1 * 2/2003 Otto ..... H01L 39/143 505/100
2012/0104382 A1 * 5/2012 Lee ..... H01L 31/105 257/43
2012/0119609 A1 * 5/2012 Janecek ..... H02K 3/18 310/208
2016/0293296 A1 * 10/2016 Ichiki ..... H01L 39/141

* cited by examiner

*Primary Examiner* — Paul A Wartalowicz
(74) *Attorney, Agent, or Firm* — Eversheds Sutherland (US) LLP

(57) ABSTRACT

A superconducting magnet which provides a barrier to current flow transverse to the length of the superconductor at operational temperature and voltages, while also providing a magnetic quench protection mechanism for the superconducting magnet. The superconducting magnet comprising a plurality of winding turns of superconductive material wound into a coil and a variable electrically resistive layer varying with either temperature or voltage positioned between at least of portion of the plurality of winding turns of the superconductive material, wherein the variable electrically resistive layer has a negative temperature coefficient of resistance or is a semiconductor with a threshold voltage greater than operational voltages.

3 Claims, 6 Drawing Sheets

SUPERCONDUCTING MAGNET HAVING A VARIABLE ELECTRICALLY RESISTIVE LAYER AND METHOD OF USE

CROSS-REFERENCE TO RELATED APPLICATIONS

This application claims priority to currently U.S. Provisional Patent Application 62/194,587 entitled, "Novel Electronic Barriers to Current Flow Across Turns in Superconducting Magnets", filed Jul. 20, 2015.

STATEMENT OF GOVERNMENT INTEREST

This invention was made with government support under Grant No. DMR-1157490 awarded by the National Science Foundation under the National High Magnetic Field Laboratory (NHMFL). The Government has certain rights in the invention.

BACKGROUND OF THE INVENTION

A superconducting magnet is an electromagnet made from coils of superconducting wire, tape or cable which operates in a superconducting state to conduct much larger electric currents than is possible with ordinary wire, thereby creating intense magnetic fields. Superconducting magnets are commonly used in MRI (magnetic resonance imaging) machines and in NMR (nuclear magnetic resonance) spectrometers.

Superconducting magnets currently known in the art may include electrical insulation positioned between the turns of the superconducting coil. With the electrical insulation positioned between the turns of the superconducting coil, the electric current in the magnet is only permitted to flow in a direction parallel to the length of the superconductor. In general, the current flowing in a direction along the length of the superconductor is herein referred to as a parallel current and the current flowing in a direction transverse to the length of the superconductor, across turns of the superconducting coil, is herein referred to as a transverse, or radial, current. In addition, the current flowing from the positive lead to the negative lead of the superconducting coil is herein referred to as the superconducting coil current, wherein the superconducting coil current is equal to the sum of the net parallel current and the net transverse current within the superconducting coil.

Voltage differentials in superconducting coils are a result of either resistive current flow, as described above, or a result of the inductance of the superconducting magnet itself. Resistive portions and the associated resistive current flow and resistive voltage differentials are created in the superconducting magnet as a result of temperature increases from discrete or global heat sources such as wire motion, epoxy cracking, insufficient cooling, flux jumps, radiation or other sources. Resistive current flow may also result from the operation of the superconducting magnet at magnetic fields, currents, temperatures, and/or strains which are above one or more critical limits of the superconducting material. Additionally, the resistive current flow may vary along a length of the superconducting material. Voltages due to resistive current flow in a resistive portion of the superconducting material are herein referred to as resistive voltages. Resistive voltages within the superconducting magnet produce internal heating within the superconducting magnet, in the region of the resistive voltage, wherein the internal heating is equal to the product of the resistive voltage and the current flowing from the higher voltage potential (VU) to the lower voltage potential (VL). Internal heating of the superconducting magnet due to resistive voltages is herein referred to as resistive heating.

Inductive voltages in the superconducting magnet are created by magnetic field or electric current changes on, or in, the superconducting magnet as a result of the inductance of the superconducting magnet. Voltages due to inductance of the superconducting magnet are herein referred to as inductive voltages. Inductive voltages in superconducting magnets having electrical insulation between the coils do not result in resistive heating. However, resistive voltages in superconducting magnets having electrical insulation between the coils do result in resistive heating, wherein the resistive heating is equal to the product of the superconducting coil current and the resistive voltage.

In the case of superconducting magnets having metallic or electrically conductive layers between the coils, inductive voltages do not generate resistive heating as a result of the parallel current. However, resistive heating is generated as a result of the transverse current in superconducting magnets having metallic or electrically conductive layers between the coils, wherein the resistive heating is equal to the product of the transverse current of the superconducting current and the transverse voltage between turns of the coil. In addition, resistive voltages in superconducting magnets having metallic or electrically conductive layers between the coils generate resistive heating as a result of the parallel current and the transverse current, wherein the resistive heating is equal to the sum of the product of the longitudinal resistive voltage and the parallel current and the product of the transverse resistive voltage and the transverse current.

In any superconducting coil, resistive heating tends to increase the temperature of the material in the resistive portion of the superconducting coil, and in the local proximity of the resistive portion of the superconducting coil as the temperature gradients conduct heat away from the resistive portion. If protective action is not taken to prevent this resistive heating, the peak temperatures and temperature gradients across the coil can permanently damage the superconducting coil.

In a superconducting magnet employing a metallic or electrically conductive layer between the turns of the coil, the requirement for detection of the resistive state and activation of a protection scheme is reduced or eliminated as a result of the presence of the alternate current path that is transverse to the length of the superconductor. The allowed transverse current is effective in distributing the resistive heating of the superconducting coil over a larger volume and thereby provides superior protection from resistive voltages, as compared to the superconducting coil having electrical insulation between the coils. The reduction or elimination of resistive voltage detection and protection schemes is a desirable characteristic because it reduces the costs associated with implementing the detection and protection schemes. In addition, improved protection from resistive voltages provided by the metallic or electrically conductive layers in the coil reduces the risk of permanently damaging the superconducting coil. However, in the superconducting magnet having metallic or electrically conductive layers, the operational inductive voltages of the superconducting material produce undesirable resistive heating as a result of the transverse current flow across turns of the coil. Resistive heating raises the temperature of the superconducting coil which requires more refrigeration capacity or longer recovery times to return to operational temperatures, both of which are costly and therefore undesirable in a superconducting magnet. In addition to the undesirable resistive heating from the transverse current, the transverse current does not contribute to the desired produced magnetic field of the superconducting magnet. The transverse portion of the superconducting coil current has a decay time constant equal to the ratio of the coil inductance divided by the resistance to transverse current flow. As such, the desired produced magnetic field does not change linearly in time along with the changing coil current because a portion of the coil current is directed transversely to the superconductor length and, as such, does not contribute to the desired produced magnetic field. The non-linear magnetic field versus superconducting current is an undesirable performance characteristic of a superconducting magnet having a metallic or other electrically conductive layer or coating.

In addition to superconductors having electrical insulation between turns of the coil, superconducting coils are also known in the art that do not include electrical insulation between the turns of the coil, or alternatively, superconducting coils are known that include a metallic layer or an other electrically conductive layer between the turns of the superconductor. In a superconducting magnet without an electrical insulation between the coils, or with an electrically conductive material positioned between the coils, electric current can flow both parallel and transverse to the length of the superconducting material. However, in a superconducting magnet having an electrical insulation between the turns of the coil, the electric current is only permitted to flow parallel to the length of the superconducting material. In a superconducting magnet having an electrical insulation layer between the turns of the coil, detection of the resistive state in the superconducting coil and activation of a protection scheme to more evenly internally distribute the magnetically stored energy and resistive current from a power supply throughout the superconducting coil and/or to distribute the stored energy and resistive current to hardware external to the superconducting coil to prevent damage, may be installed to safely distribute the energy over as large a volume of the coil as possible, thereby preventing peak temperatures and temperature gradients from damaging the magnet. In addition, further protection of the superconducting coil in the resistive state may be provided by employing a resistive material, such as copper, within the superconducting coil itself or in a metallic conductor wound together with the superconducting coil. While the metallic conductor is effective in decreasing the overall current density of the superconducting coil in a resistive state to protect the superconducting coil from damage, incorporating a metallic conductor into the superconducting coil also reduces the efficiency of the superconducting coil in producing the desired magnetic field, which is undesirable.

Accordingly, what is needed in the art is a superconducting magnet which provides a barrier to current flow transverse to the length of the superconductor, while also providing a magnetic quench protection mechanism. However, in view of the art considered as a whole at the time the present invention was made, it was not obvious to those of ordinary skill in the field of this disclosure how the shortcomings of the prior art could be overcome.

SUMMARY OF THE INVENTION

The present invention provides a superconductor, a superconducting magnet and a method of preventing quenching in a superconducting magnet, wherein the superconducting magnet is formed from a coiled superconductor having a variable electrically resistive layer.

In one embodiment, the present invention provides a superconductor comprising a superconductive material and a variable electrically resistive layer adjacent to at least a portion of the superconductive material, wherein the variable electrically resistive layer has a negative temperature coefficient of resistance.

In various embodiments, the superconductive material of the superconductor may be in a superconducting wire, a superconducting tape or a superconducting cable. In addition, the superconducting material of the superconductor may be niobium-titanium (NbTi), niobium-tin ($Nb_3Sn$), Earth, Barium, Copper Oxide (ReBCO), magnesium diboride ($MgB_2$), bismuth strontium calcium copper oxide (BSCCO), n=2 compound of bismuth strontium calcium copper oxide (Bi2212) and n=3 compound of bismuth strontium calcium copper oxide (Bi2223), or combinations thereof.

In various embodiments, the variable electrically resistive layer may be a semiconductor layer, a silicon-based semiconductor layer, an organic semiconductor layer, a semiconducting polymer layer, a metal oxide layer and a carbon layer, or combinations thereof. In addition, if the variable electrically resistive layer is a metal oxide layer, the metal oxide layer may be chromium oxide, iron oxide, zinc oxide and copper oxide, or combinations thereof.

In an additional embodiment, the present invention provides a superconducting magnet, which includes a plurality of winding turns of superconductive material wound into a coil and a variable electrically resistive layer positioned between at least of portion of the plurality of winding turns of the superconductive material, wherein the variable electrically resistive layer has a negative temperature coefficient of resistance.

In a particular embodiment, the coil of the superconducting magnet omits an electrically conductive layer positioned between the plurality of winding turns of the superconductive material and in an additional embodiment, the coil omits an electrically insulative layer positioned between the plurality of winding turns of the superconductive material.

The present invention additionally provides, a method for preventing quenching of a superconducting magnet which includes, positioning a variable electrically resistive layer between at least a portion of a plurality of winding turns of a superconducting magnet, the superconducting magnet comprising a plurality of winding turns of superconductive material wound into a coil and the variable electrically resistive layer having a negative temperature coefficient of resistance and, in response to a temperature increase in the superconducting magnet, lowering the resistance of the variable electrically resistive layer to allow transverse current to flow between the winding turns of the superconducting magnet, thereby preventing quenching of the superconducting magnet.

These and other important objects, advantages, and features of various embodiments will become clear as this disclosure proceeds. Various embodiments accordingly comprise the features of construction, combination of elements, and arrangement of parts that will be exemplified in the disclosure set forth hereinafter and the scope of the various embodiments will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

Figure 1:
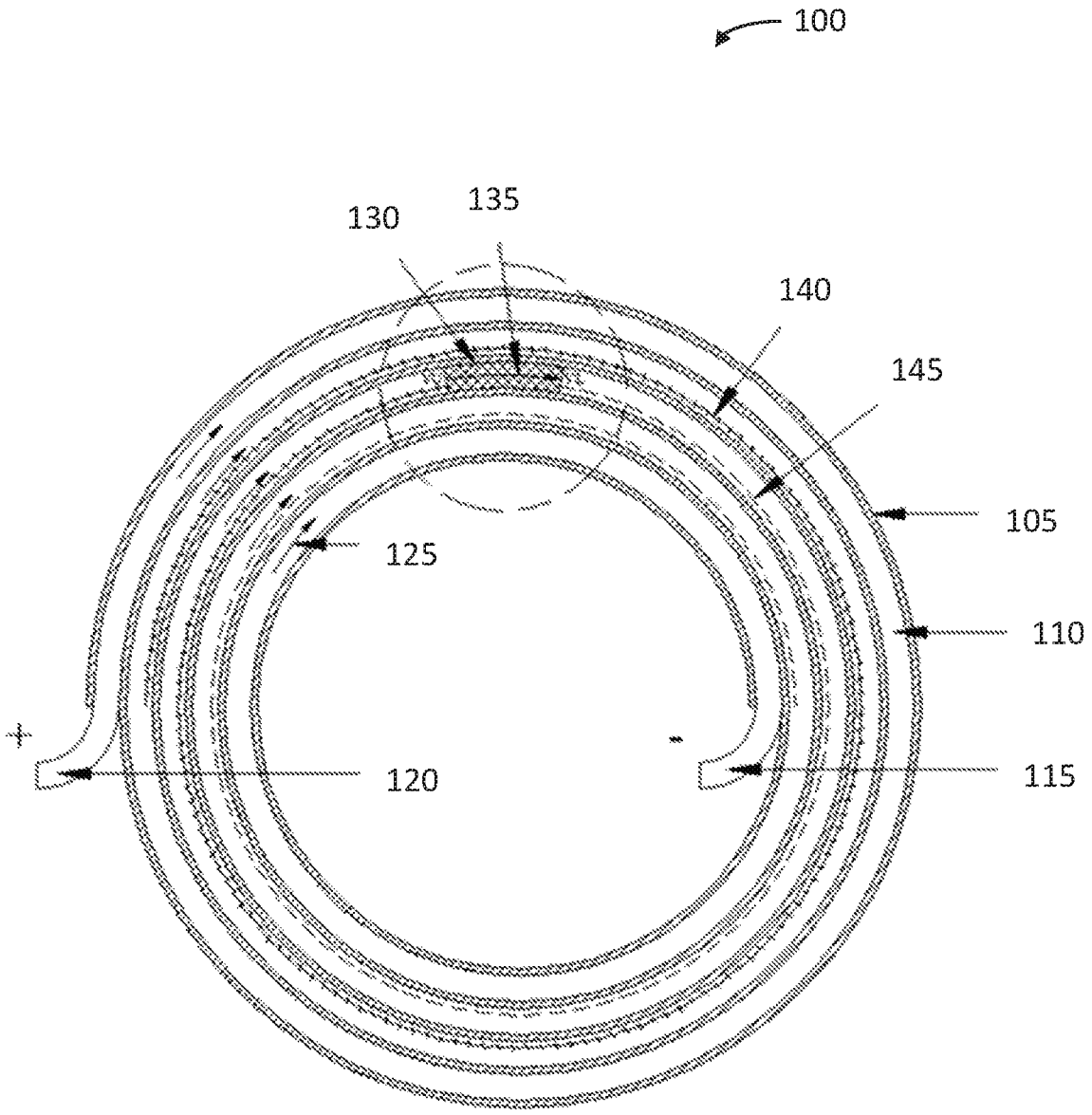
Fig. 1 Prior Art
FIG. 1 is a schematic diagram of a prior art insulated embodiment of a superconductor coil.
Figure 2:
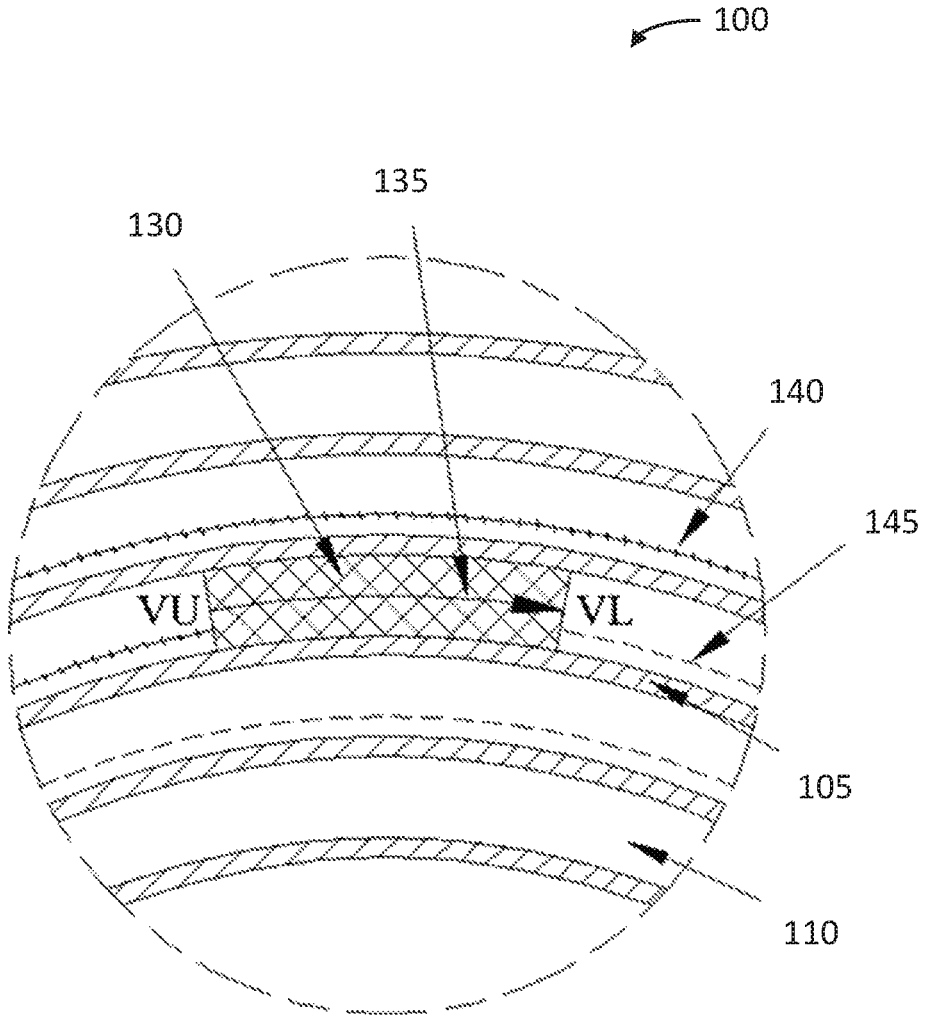
Fig. 2 Prior Art
FIG. 2 is detailed view of a portion of the superconductor coil of FIG. 1 showing the direction of current flow in the resistive portion of the superconductor and the equipotential lines produced by the resistive portion.

As illustrated in the prior art embodiment in FIG. 1, a superconducting magnet, in the form of a superconducting coil 100, includes electrical insulation 105 positioned on the superconducting material itself 110, or alternatively positioned between the layers of the superconducting material 110, when the superconducting magnet is in a coiled configuration. The electrical insulation 105 is effective in preventing a transverse flow of current between the turns of the coil. The superconducting magnet 100 may comprise a negative lead 115 and a positive lead 120 to provide for an input of current to the superconducting coil 100. The arrows 125 indicate the direction of the flow of the parallel current within the superconducting material 110 of the superconducting coil 100. The superconducting coil 100 may further include a resistive portion 130, wherein the arrow 135 indicates the current flowing through the resistive portion 130 of the superconducting coil 100, which results in a resistive voltage differential across the resistive portion 130 equal to an upper voltage VU minus a lower voltage VL. As shown in more detail in FIG. 2, the flow of current through the resistive portion 130 of the superconducting coil 100 results in an upper voltage VU at a first end of the resistive portion 130 and a lower voltage VL and a second end of the resistive portion 130. Due to the characteristics of a superconducting material 110 and the resistive portion 130 of the superconducting coil 100, equipotential lines result in the coil, as shown by lines 140 and 145, which are equal to VU and VL, respectively. As such, as a result of the characteristics of the electrical insulation 105, a parallel current flows through the turns of the superconducting magnetic coil 100 and the electrical insulation is effective in preventing a transverse current from flowing across the turns of the superconducting magnetic coil 100.

Figure 3:
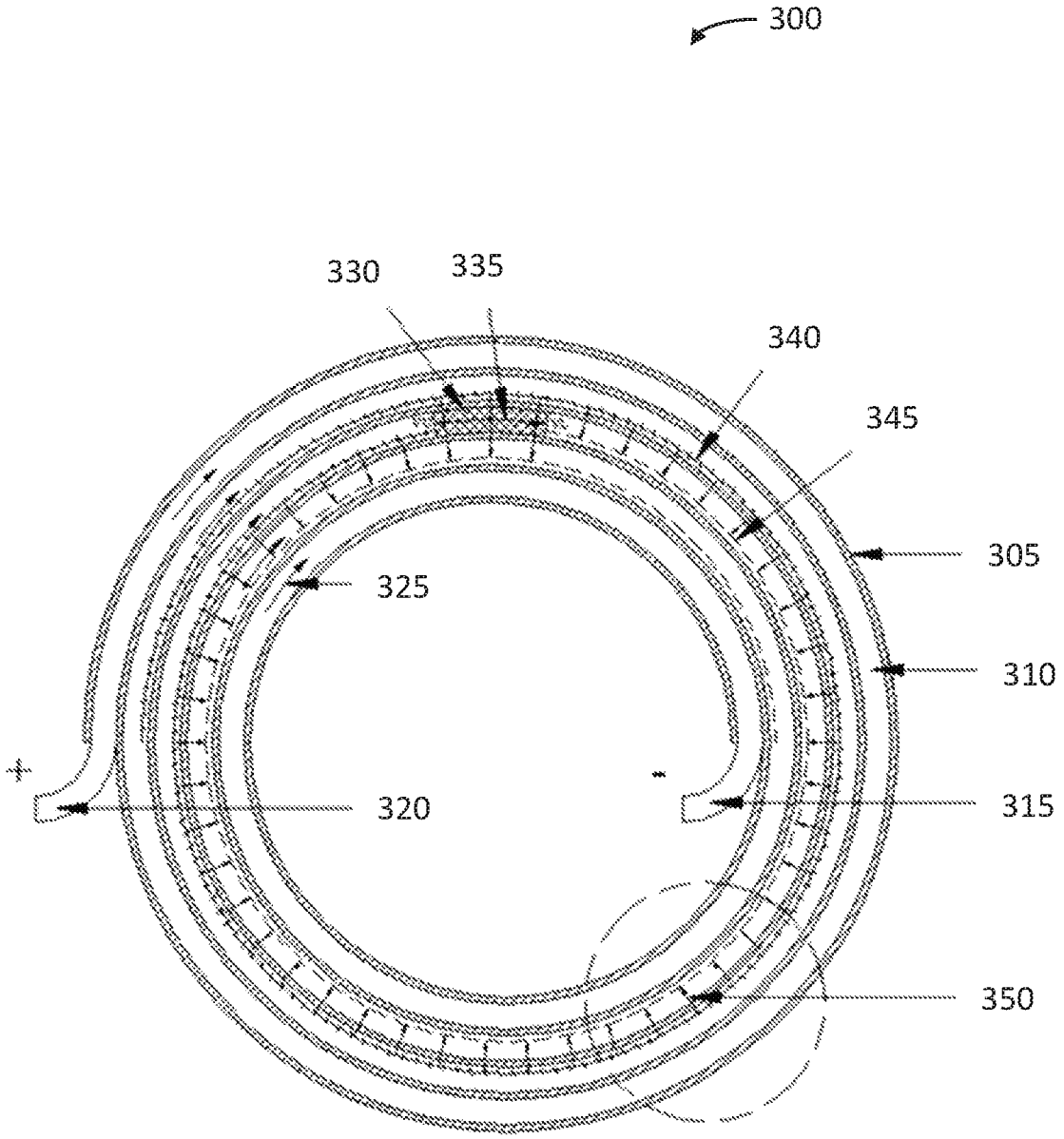
Fig. 3 Prior Art
FIG. 3 is a schematic diagram of a prior art metallic embodiment of a superconducting coil.
Figure 4:
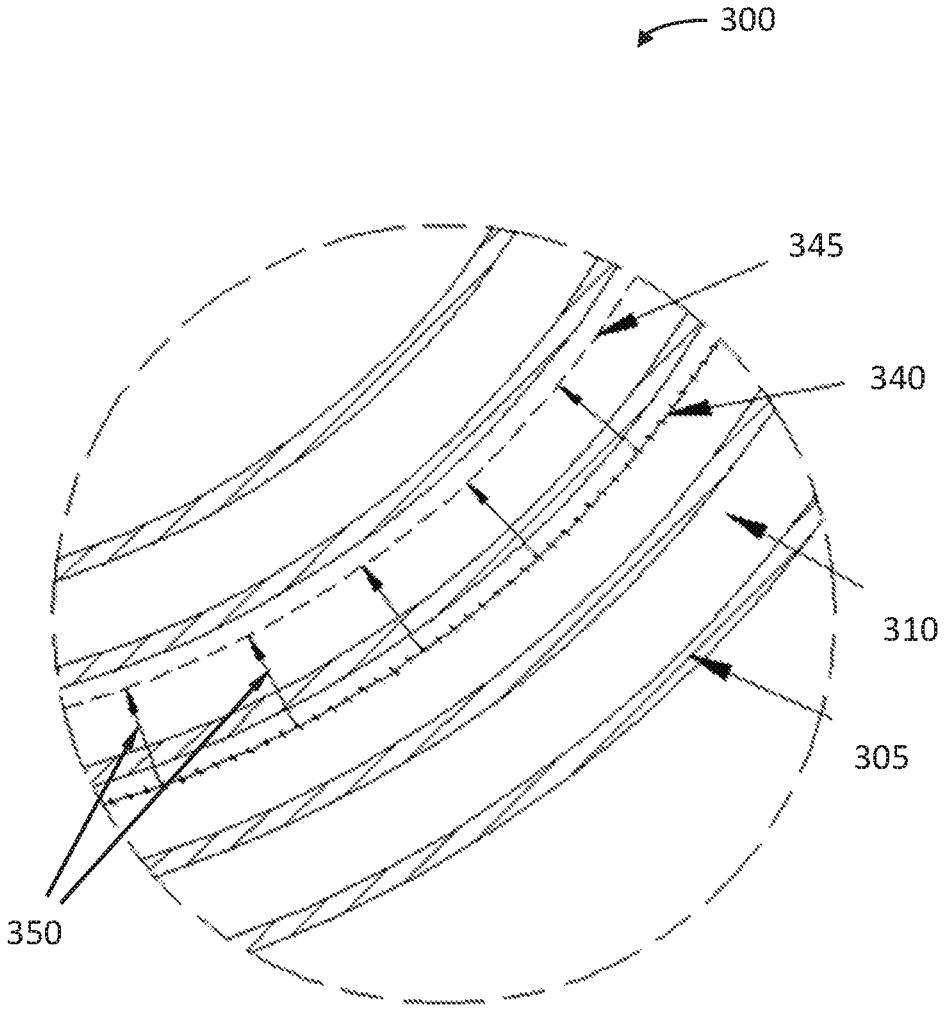
Fig. 4 Prior Art
FIG. 4 is detail view of a portion of the superconductor coil of FIG. 3 showing the direction of transverse current flow.

In addition to superconductors having electrical insulation between turns of the coil, superconducting coils are also known in the art that do not include electrical insulation between the turns of the coil, or alternatively, superconducting coils are known that include a metallic layer or an other electrically conductive layer between the turns of the superconductor. In a superconducting magnet without an electrical insulation between the coils, or with an electrically conductive material positioned between the coils, electric current can flow both parallel and transverse to the length of the superconducting material 110. In the prior art embodiment illustrated in FIG. 3, a superconducting magnet, in the form of a superconducting coil 300, includes a metallic or other electrically conductive layer 305 positioned on the superconductor material itself 310, or alternatively positioned between the layers of the superconducting material 310, when the superconducting magnet is in the coiled configuration. The superconducting magnet 300 may comprise a negative lead 315 and a positive lead 320 to provide for an input of current to the superconducting coil 300. The arrow 325 indicates the direction of the flow of the parallel current within the superconducting material 310 of the superconducting coil 300. The superconducting coil 300 may further include a resistive portion 330, wherein the arrow 335 indicates the current flowing through the resistive portion 330 of the superconducting coil 300, which results in a resistive voltage differential across the resistive portion 330 equal to an upper voltage VU minus a lower voltage VL. In addition, as a result of the voltage differential across the resistive portion 330, radial or transverse currents flow between the adjacent turns of the coil. As shown in more detail in FIG. 4, radial currents, as indicated by arrows 350, flow between the adjacent turns of the coil due to the voltage differences 340, 345 between the adjacent turns in the resistive portion 330 of the superconductor coil 300 in the absence of an electrical insulator between the adjacent turns. The radial currents 350 in FIG. 3 and FIG. 4 are effective in distributing heat energy over a larger superconducting coil volume, thereby reducing or eliminating the threat of damage to the superconducting coil 300 due to resistive heating (quenching).

Figure 5:
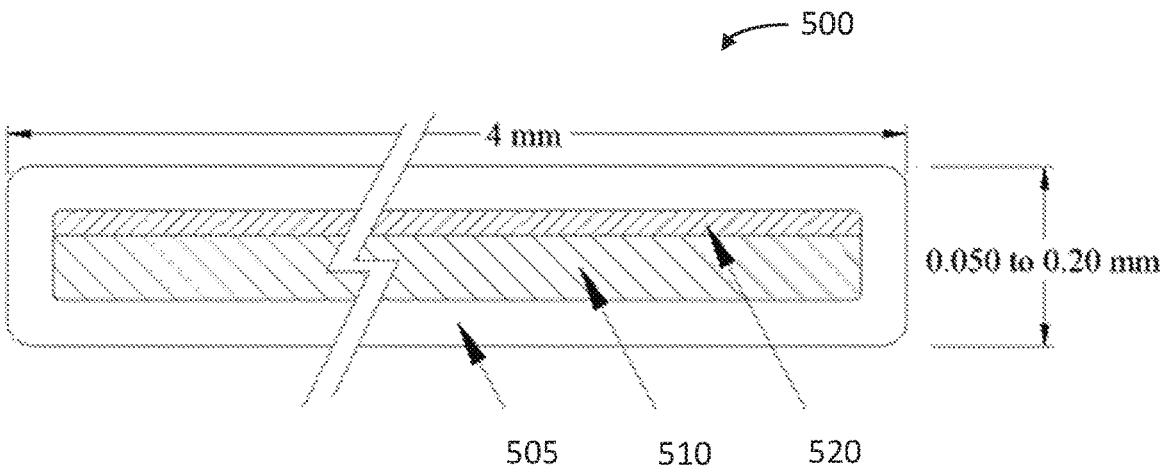
Fig. 5 Prior Art
FIG. 5 is a cross-sectional schematic view of a prior art commercially available, high temperature superconducting ReBCO tape.

As such, while the metallic conductor is effective in decreasing the overall current density of the superconducting coil in a resistive state to protect the superconducting coil from damage, incorporating a metallic conductor into the superconducting coil also reduces the efficiency of the superconducting coil in producing the desired magnetic field, which is undesirable In a particular prior art embodiment, illustrated with reference to FIG. 5, a schematic cross-sectional view of a commercially available high temperature superconducting ReBCO tape 500 comprising a copper material 505 required to protect the superconducting coil when the superconducting material 510 becomes resistive. The tape 500 may further comprise a high-strength substrate 520 made from Hastelloy positioned over the superconducting ReBCO material 510. As such, the ReBCO tape 500 of FIG. 5 includes a metallic layer that provides protection against quenching of a superconducting magnetic coil formed of the superconductive tape 500.

Figure 6:
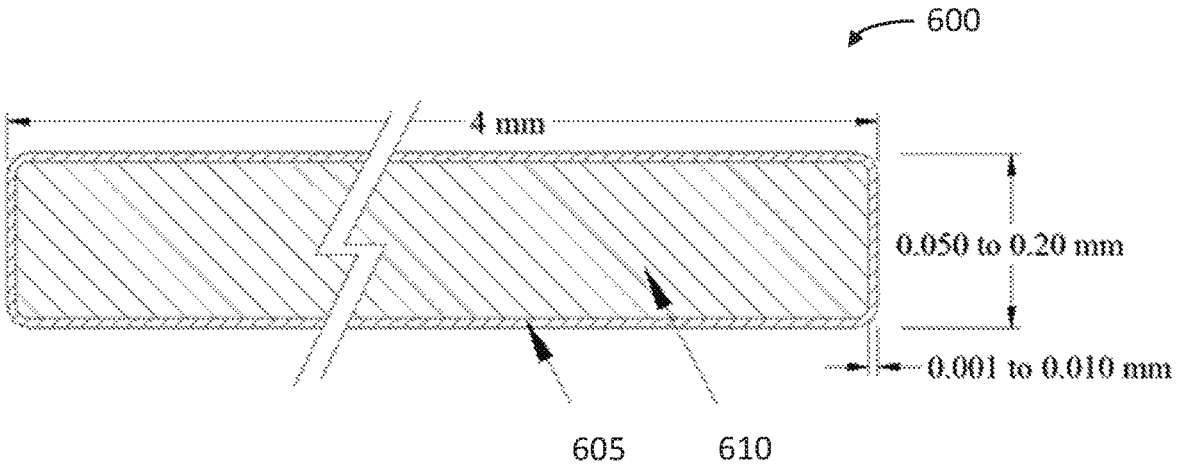
FIG. 6 is a cross-sectional schematic view of a variable electronic barrier on a superconducting tape.

With reference to FIG. 6, in accordance with the present invention, a superconductor 600 is provided which includes a superconducting material 610, such as ReBCO, and a novel variable electrically resistive layer 605 surrounding the superconducting material 610 to form the superconductor 600. In the illustrated embodiment, the superconductor 600 is in the form of a tape, however, this is not intended to be limiting and it is within the scope of the present invention for the superconductor to be in the form of a wire, cable or in the form of any other conductor known in the art. Superconducting wire, tape and cables in many forms are used to form superconducting magnets. Superconducting wire, tape and cables in any form used in superconducting magnets are herein referred to as a superconductor.

In accordance with the present invention, the variable electrically resistive layer 605 has a negative coefficient of resistance, such that the resistance of the variable electrically resistive layer 605 decreases as its temperature increases. Various materials are known in the art having a negative coefficient of resistance, and in particular, semiconductor materials are known to have a negative coefficient of resistance. Accordingly, the variable electrically resistive layer 605 may be formed of a semiconductor material which provides a barrier to current flow. The semiconductor layer forming the variable electrically resistive layer 605 may be a coating applied to the superconducting material 610 itself, or alternatively, the semiconductor layer may be a separate material layer positioned between the coils of the superconducting magnet. The variable electrically resistive layer 605 prevents or reduces the flow of current transverse to the length of the superconductor 600 at lower temperatures and/or at higher voltages, by lowering the resistance to current flow which is dependent upon the temperature level and/or voltage of the variable electrically resistive layer 605.

As such, superconducting coil magnets in accordance with the present invention employ a variable electrically resistive layer 605 on or between layers of the superconductor 610.

The superconductor 600, and associated superconducting magnet form of the superconductor 600, in accordance with various embodiments of the present invention may reduce or eliminate the undesirable effects of the prior art and may allow more compact, less expensive, higher performance superconducting coil systems. These improvements may be accomplished by decreasing the size of the superconducting coil required to produce the desired magnetic field and by reducing and/or eliminating ancillary superconducting magnet system components such as cryogenic refrigeration, mechanical reinforcement and superconducting magnet protection systems. At the same time, the superconductor of the present invention may reduce or eliminate the undesirable superconducting coil heating resulting from normal operational changing coil currents and magnetic fields and non-linearities between normal operational changing coil currents and the desired produced magnetic field.

Referring back to the schematic representation in FIG. 3, the transverse currents 350 flowing between turns in the superconducting coil 300 is due to the voltage differences in the adjacent turns within the resistive portion 330 of the superconductor 310. In comparison, with reference to FIG. 6, in an embodiment of the present invention, the resistance of the transverse currents in a coil formed of the superconductor 600 having a variable electrically resistive layer 605 is increased in varying degrees, depending upon the barrier used, up to the limit of a completely insulative barrier, at the normal superconducting magnet 600 operational voltages and temperatures due to the variable electronic properties of the barrier 605 between turns, as a function of voltage and temperature. In the present invention, the resistance of the transverse currents within a coil of the superconductor 600 is decreased at increased superconducting magnet operational voltages and temperatures due to resistive heating. The decrease occurs in varying degrees depending on the specific variable electrically resistive layer 605 used, to the limit of a low resistance layer that optimally distributes the resistive heating equally over the maximum volume of the superconducting coil, which provides the maximum available self-protection against damage of the superconducting coil formed of the superconductor 600 due to quenching. In general, the superconductor of the present invention allows transverse currents in a controlled amount depending on the temperature of the superconductor 600 and the resulting temperature of the variable electrically resistive layer 605.

In a coiled embodiment of a superconducting magnet formed by the superconductor 600 of the present invention, operating temperatures of the coil may reduce current flow between turns in varying degrees, depending upon the specific variable electrically resistive layer 605 employed, up to the desired limit of infinite resistance, which is equal to the desired performance characteristics of the insulated embodiment of the prior art, during normal operational changing of coil current and magnetic field.

As previously described, in the event of resistive heating, the temperature and voltage of the superconductor increases in the resistive portion and in the proximity of the resistive portion due to current flowing in the resistive portion in the superconductor. As the temperature and voltage increases, the resistance of the variable electrically resistive layer 605 decreases by varying degrees, depending upon the specific characteristics of the variable electrically resistive layer 605 employed, to the limit of the metallic embodiment of the prior art, allowing more current to flow across the turns of the coil and thereby distributing the resistive heating over a larger volume of the superconducting coil in a manner which is desirable to protect the superconducting coil from extreme temperatures and temperature gradients that can damage the superconducting coil.

In the present invention, the resistances of the variable electrically resistive layers 605 are designed such that the total resistance to current flow transverse to the length of the superconductor is highest at the superconducting magnet operational temperatures and is reduced at the higher temperatures created by resistive heating. As such, the variable electrically resistive layer 605 of the present invention exhibits a negative coefficient of resistance. In general, a negative coefficient for a material means that its resistance decreases with an increase in temperature. Semiconductor materials, such as carbon, silicon and germanium, typically have negative temperature coefficients of resistance. In addition, the characteristic voltage of a variable electrically resistive layer, and in particular a semiconducting material, at which a large change in resistance to current flow in the semiconducting material occurs is herein referred to as the threshold voltage of the semiconducting material. In the present invention, the threshold voltage of the semiconducting material is designed such that the threshold voltage is higher than the expected operational inductive voltages of the superconducting coil, due to specified operational field and current changes in the superconducting coil, but is lower than the resistive voltages created by resistive heating. In this way, the non-linearities between changing superconducting magnet currents and the produced desired magnetic field are reduced or eliminated during normal operation. In this way, the extra inductive heating that is inherent in the prior art embodiment employing a metallic layer over the superconducting material in comparison to the prior art embodiment employing an insulated layer of the superconducting material are also reduced or eliminated during normal operation.

Various embodiments of the present invention comprise novel variable electrically resistive layer which allow more compact, and therefore less expensive, electromagnets and also allow the opportunity to eliminate expensive and complicated quench protection systems and other ancillary systems. The present invention provides a self-protecting magnet, wherein the risk of completely destroying the expensive superconducting magnet during quench can be virtually eliminated. Novel variable electrically resistive layers in accordance with the present invention mitigate delays in reaching full field during ramping and minimize inductive heating in the superconducting magnet during field changes in comparison to no-insulation layers.

Various embodiments comprise but are not limited to solenoidal, high-field, low-field, multipole, nuclear magnetic resonance (NMR), Fourier transform ion cyclotron resonance (FT-ICR), magnetic resonance imaging (MRI), general purpose, crystal puller magnets and other superconducting magnets made from high temperature and low temperature superconductors including but not limited to NbTi, $Nb_3Sn$, ReBCO, $MgB_2$, Bi2212 and Bi2223, and operated at any temperatures sufficient to allow the superconducting state using semiconducting, resistive, and/or temperature dependent resistive/insulating coatings comprising but not limited to silicon based semiconductors, organic semiconductors, semiconducting polymers, metal oxides, carbon and other resistive coatings.

FIG. 6 illustrates the variable electrically resistive layer 605 on the superconducting material 610 forming the superconductor 600 of the present invention. In an additional embodiment, in the case of a non-superconducting metallic substrate, the substrate and novel variable electrically resistive layer 605 may be employed as the insulation in FIG. 3. The variable electrically resistive layer 605, in various embodiments, may be a metal oxide such as chromium oxide, iron oxide, zinc oxide, or copper oxide, or may be a carbon allotrope, an intermetallic compound, an alloy or a resistive or semiconducting or insulating material held to the surface of the conductor 610 with, for example, a binder whose electronic properties complement those of the variable electrically resistive layer 605 to provide the required overall variable electronic properties of the variable electrically resistive layer 605.

In a particular embodiment, a variable electrically resistive layer of the present invention can employ materials typically used in cryogenic temperature sensors, which require large changes in resistance with temperature to enable sensitive indications of temperatures in the cryogenic range. For example zirconium oxy-nitride films have resistance decreases of between one and three orders of magnitude from 4 K and 300 K. Doped germanium semiconductors also show a resistance decrease of an order of magnitude between 4 K and 20 K. Both of these materials can be applied as the variable electrically resistive layer in combination with commercially available binding materials. In a specific embodiment, the variable electrically resistive layer may be formed by mixing 1868 ml of anhydrous ethanol and 112 g of 0.3 um zirconium oxy-nitride or germanium semiconductor powder for 10 minutes then adding 934 ml of Silbond H-5, a commercially available binder, continuing to mix for 5 to 15 minutes in addition to ultrasonically vibrating the solution, then applying the mixed solution to the surface of the superconducting tape or wire at 550 C for one minute. The above example is just one combination but variation of concentrations, curing times and curing temperatures with different binder materials may provide additional alternatives As illustrated in FIG. 6, a thickness of the variable electrically resistive layer 605 may range from about 0.001 mm to about 0.01 mm, which is substantially less than the insulation layer 505 of the prior art illustrated in FIG. 5. This thinner variable electrically resistive layer 605 allows for a significantly reduced overall coil diameter than with prior art insulation layers 105.

The use of novel variable electrically resistive layer 605 in superconducting coils in lieu of the prior art may reduce or eliminate the undesirable superconducting coil size, charging and discharging nonlinearities between superconducting coil current and desired produced magnetic field, and heating of the superconducting coils during charging and discharging of the superconducting coil, while maintaining the desirable protection characteristics of the prior art and thereby reduce the cost of expensive superconductor 110, structural reinforcing materials, and other ancillary system components.

Figure 7:
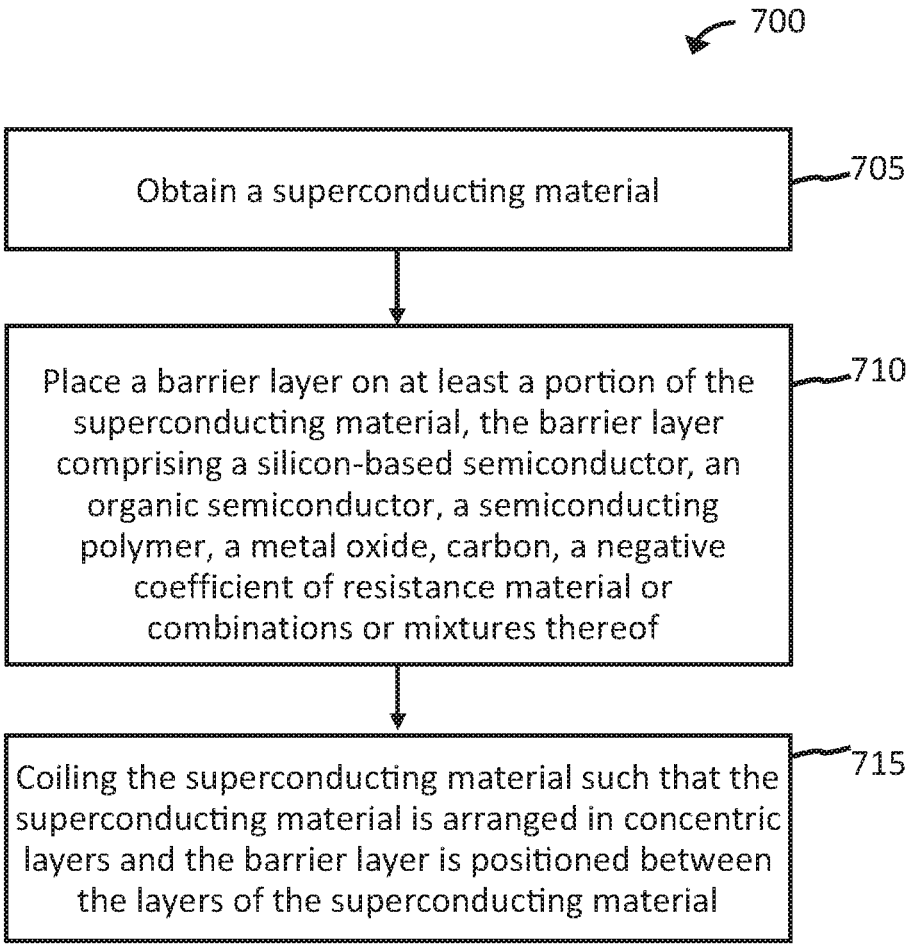
FIG. 7 is a flow diagram of an exemplary method for controlling temperature rise in a superconducting magnet.

FIG. 7 is a flowchart of an exemplary method 700 for controlling temperature rise in a superconducting magnet according to various embodiments. At step 705, a superconducting material (superconductor) may be obtained. Exemplary superconductors comprise NbTi, Nb3Sn, ReBCO, MgB2, Bi2212, Bi2223, or mixtures or combinations thereof. A variable electrically resistive layer may be placed on at least a portion of the superconductor at step 710. The variable electrically resistive layer may comprise a silicon-based semiconductor, an organic semiconductor, a semiconducting polymer, a metal oxide, carbon, a negative coefficient of resistance material or mixtures or combinations thereof. The superconductor may be coiled at step 715 such that the superconductor is arranged in concentric layers and the variable electrically resistive layer is positioned between the layers of the superconductor. The variable electrically resistive layer may have electrical resistive properties that vary with a temperature of the superconductor coil or a voltage of the superconductor coil, thereby decreasing an electrical resistance of the variable electrically resistive layer to current flow transverse to a length of the superconductor with increasing temperature or increasing voltage of the superconductor coil.

The present invention provides a superconducting magnet which provides a barrier to current flow transverse to the length of the superconductor, while also providing a magnetic quench protection mechanism for the superconducting magnet. In various embodiments, the superconducting magnet includes a plurality of winding turns of superconductive material wound into a coil and a variable electrically resistive layer positioned between at least of portion of the plurality of winding turns of the superconductive material, wherein the variable electrically resistive layer has a negative temperature coefficient of resistance.

The advantages set forth above, and those made apparent from the foregoing description, are efficiently attained. Since certain changes may be made in the above construction without departing from the scope of the disclosure, it is intended that all matters contained in the foregoing description or shown in the accompanying drawings shall be interpreted as illustrative and not in a limiting sense.

It is also to be understood that the following claims are intended to cover all of the generic and specific features of the various embodiments herein described, and all statements of the scope of the disclosure that, as a matter of language, might be said to fall therebetween.

What is claimed is:

1. A superconducting magnet consisting of:

a superconductive material in the form of a wire, tape, or cable, wherein the wire, tape, or cable has been wound into coil; and a variable electrically resistive layer coated directly onto the superconductive material, wherein the variable electrically resistive layer has a negative temperature coefficient of resistance and is configured to provide a barrier to current flow transverse to the length of the superconductive material during operation of the superconducting magnet.

2. The superconducting magnet of claim 1, wherein the variable electrically resistive layer comprises carbon, silicon, germanium, a metal oxide, or a combination thereof.

3. The superconducting magnet of claim 2, wherein the variable electrically resistive layer has a thickness from 0.001 mm to 0.01 mm.

* * * * *